US010707629B2

(12) United States Patent
Montena et al.

(10) Patent No.: US 10,707,629 B2
(45) Date of Patent: Jul. 7, 2020

(54) GROUNDING MEMBER FOR COAXIAL CABLE CONNECTOR

(71) Applicant: PPC Broadband, Inc, East Syracuse, NY (US)

(72) Inventors: Noah P. Montena, Syracuse, CT (US); Robert M. Parker, Aurora, CO (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 15/650,521

(22) Filed: Jul. 14, 2017

(65) Prior Publication Data

US 2017/0317454 A1 Nov. 2, 2017

Related U.S. Application Data

(63) Continuation of application No. 14/920,150, filed on Oct. 22, 2015, now Pat. No. 9,711,917, which is a (Continued)

(51) Int. Cl.

| | |
|---|---|
| ***H01R 24/38*** | (2011.01) |
| ***H01R 9/05*** | (2006.01) |
| *H01R 103/00* | (2006.01) |

(52) U.S. Cl.

CPC ..... *H01R 24/38* (2013.01); *H01R 9/05* (2013.01); *H01R 2103/00* (2013.01)

(58) Field of Classification Search

CPC ..... H01R 9/05; H01R 9/0519; H01R 24/38; H01R 13/59; H01R 13/5202; H01R 13/6277

(Continued)

(56) References Cited

U.S. PATENT DOCUMENTS

| | | | |
|---|---|---|---|
| 331,169 | A | 11/1885 | Thomas |
| 1,371,742 | A | 3/1921 | Dringman |

(Continued)

FOREIGN PATENT DOCUMENTS

| | | | |
|---|---|---|---|
| CA | 2096710.00 | A1 | 11/1994 |
| CN | 101060690.00 | A | 10/2007 |

(Continued)

OTHER PUBLICATIONS

ARRIS1; Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

(Continued)

*Primary Examiner* — Hien D Vu

(74) *Attorney, Agent, or Firm* — MH2 Technology Law Group, LLP

(57) ABSTRACT

A connector including coupling and sleeve flanges defining opposing recesses separated by an axial gap along an elongate axis. The connector also includes a arcuate bridge member radially biased outwardly against at least one of the internal contact surfaces of the opposing recesses and spanning the axial gap. The arcuate bridge member maintains electrical conductivity across the axial gap even when the sleeve does not electrically contact the coupling member. At least one of the contact surfaces defines a conical surface which is responsive to the radially biased conductive bridge member to produce a radial force against the internal contact surfaces. The radial force produces an axial force component along the elongate axis.

35 Claims, 5 Drawing Sheets

Related U.S. Application Data continuation-in-part of application No. 13/479,123, filed on May 23, 2012, now Pat. No. 9,203,167.

(60) Provisional application No. 61/490,373, filed on May 26, 2011.

(58) Field of Classification Search
USPC ..... 439/578, 584, 585, 322
See application file for complete search history.

(56) References Cited

U.S. PATENT DOCUMENTS 1,667,485 A 4/1928 MacDonald
1,766,869 A 6/1930 Austin
1,801,999 A 4/1931 Bowman
1,885,761 A 11/1932 Peirce, Jr.
2,013,526 A 9/1935 Schmitt
2,102,495 A 12/1937 England
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,665,729 A 1/1954 Terry
2,694,187 A 11/1954 Nash
2,694,817 A 11/1954 Roderick
2,754,487 A 7/1956 Carr et al.
2,755,331 A 7/1956 Melcher
2,757,351 A 7/1956 Klostermann
2,762,025 A 9/1956 Melcher
2,805,399 A 9/1957 Leeper
2,816,949 A 12/1957 Curtiss
2,870,420 A 1/1959 Malek
3,001,169 A 9/1961 Blonder
3,015,794 A 1/1962 Kishbaugh
3,091,748 A 5/1963 Takes et al.
3,094,364 A 6/1963 Lingg
3,184,706 A 5/1965 Atkins
3,194,292 A 7/1965 Borowsky
3,196,382 A 7/1965 Morello, Jr.
3,245,027 A 4/1966 Ziegler, Jr.
3,275,913 A 9/1966 Blanchard et al.
3,278,890 A 10/1966 Cooney
3,281,757 A 10/1966 Bonhomme
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,677 A 10/1967 Daum
3,355,698 A 11/1967 Keller
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,601,776 A 8/1971 Curl
3,629,792 A 12/1971 Dorrell
3,633,150 A 1/1972 Swartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,706,958 A 12/1972 Blanchenot
3,710,005 A 1/1973 French
3,739,076 A 6/1973 Schwartz
3,744,007 A 7/1973 Horak
3,744,011 A 7/1973 Blanchenot
3,778,535 A 12/1973 Forney, Jr.
3,781,762 A 12/1973 Quackenbush
3,781,898 A 12/1973 Holloway
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,858,156 A 12/1974 Zarro
3,879,102 A 4/1975 Horak
3,886,301 A 5/1975 Cronin et al.
3,907,399 A 9/1975 Spinner
3,910,673 A 10/1975 Stokes
3,915,539 A 10/1975 Collins
3,936,132 A 2/1976 Hutter
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
4,017,139 A 4/1977 Nelson
4,022,966 A 5/1977 Gajajiva
4,030,798 A 6/1977 Paoli
4,046,451 A 9/1977 Juds et al.
4,053,200 A 10/1977 Pugner
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,106,839 A 8/1978 Cooper
4,109,126 A 8/1978 Halbeck
4,125,308 A 11/1978 Schilling
4,126,372 A 11/1978 Hashimoto et al.
4,131,332 A 12/1978 Hogendobler et al.
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Boutros
4,193,655 A 3/1980 Herrmann, Jr.
4,194,338 A 3/1980 Trafton
4,225,162 A 9/1980 Dola
4,227,765 A 10/1980 Neumann et al.
4,229,714 A 10/1980 Yu
4,250,348 A 2/1981 Kitagawa
4,280,749 A 7/1981 Hemmer
4,285,564 A 8/1981 Spinner
4,290,663 A 9/1981 Fowler et al.
4,296,986 A 10/1981 Herrmann et al.
4,307,926 A 12/1981 Smith
4,322,121 A 3/1982 Riches et al.

(56) References Cited

U.S. PATENT DOCUMENTS 4,326,769 A 4/1982 Dorsey et al.
4,339,166 A 7/1982 Dayton
4,346,958 A 8/1982 Blanchard
4,354,721 A 10/1982 Luzzi
4,358,174 A 11/1982 Dreyer
4,359,254 A 11/1982 Gallusser
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGreary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,126 A 4/1988 Gutter et al.
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,227 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.

(56) References Cited

U.S. PATENT DOCUMENTS

| | | | |
|---|---|---|---|
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |
| 5,316,494 | A | 5/1994 | Flanagan et al. |
| 5,318,459 | A | 6/1994 | Shields |
| 5,321,205 | A | 6/1994 | Bawa et al. |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawagauchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,435,751 | A | 7/1995 | Papenheim et al. |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,474,478 | A | 12/1995 | Ballog |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,325 | A | 3/1997 | Toma |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hse |
| 5,702,263 | A | 12/1997 | Baumann et al. |
| 5,722,856 | A | 3/1998 | Fuchs et al. |
| 5,735,704 | A | 4/1998 | Anthony |
| 5,746,617 | A | 5/1998 | Porter, Jr. et al. |
| 5,746,619 | A | 5/1998 | Harting et al. |
| 5,769,652 | A | 6/1998 | Wider |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,897,795 | A | 4/1999 | Lu et al. |
| 5,921,793 | A | 7/1999 | Phillips |
| 5,938,465 | A | 8/1999 | Fox, Sr. |
| 5,944,548 | A | 8/1999 | Saito |
| 5,951,327 | A | 9/1999 | Marik |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,937 | A | 2/2000 | Esh |
| 6,032,358 | A | 3/2000 | Wild |
| 6,042,422 | A | 3/2000 | Youtsey |
| 6,048,229 | A | 4/2000 | Lazard, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,162,995 | A | 12/2000 | Bachle et al. |
| 6,210,216 | B1 | 4/2001 | Tso-Chin et al. |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| D462,327 | S | 9/2002 | Montena |
| 6,439,899 | B1 | 10/2002 | Muzslay et al. |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |

(56) References Cited

U.S. PATENT DOCUMENTS 6,676,446 B2 1/2004 Montena
6,683,253 B1 1/2004 Lee
6,692,285 B2 2/2004 Islam
6,705,884 B1 3/2004 McCarthy
6,709,280 B1 3/2004 Gretz
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaria
6,752,633 B2 6/2004 Aizawa et al.
6,767,248 B1 7/2004 Hung
6,769,926 B1 8/2004 Montena
6,769,933 B2 8/2004 Bence et al.
6,780,029 B1 8/2004 Gretz
6,780,052 B2 8/2004 Montena et al.
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,817,897 B2 11/2004 Chee
6,692,286 B1 12/2004 De Cet
6,848,939 B2 2/2005 Stirling
6,848,940 B2 2/2005 Montena
6,873,864 B2 3/2005 Kai et al.
6,882,247 B2 4/2005 Allison et al.
6,884,113 B1 4/2005 Montena
6,884,115 B2 4/2005 Malloy
6,898,940 B2 5/2005 Gram et al.
6,916,200 B2 7/2005 Burris et al.
6,926,508 B2 8/2005 Holland
6,929,265 B2 8/2005 Holland et al.
6,929,508 B1 8/2005 Holland
6,939,169 B2 9/2005 Islam et al.
6,948,976 B2 9/2005 Goodwin et al.
6,971,912 B2 12/2005 Montena et al.
7,004,788 B2 2/2006 Montena
7,011,547 B1 3/2006 Wu
7,029,304 B2 4/2006 Montena
7,029,326 B2 4/2006 Montena
7,063,565 B2 6/2006 Ward
7,070,447 B1 7/2006 Montena
7,074,081 B2 7/2006 Hsia
7,086,897 B2 8/2006 Montena
7,097,499 B1 8/2006 Purdy
7,097,500 B2 8/2006 Montena
7,102,668 B2 9/2006 Montena
7,102,868 B2 9/2006 Montena
7,108,548 B2 9/2006 Burris et al.
7,114,990 B2 10/2006 Bence et al.
7,118,416 B2 10/2006 Montena et al.
7,125,283 B1 10/2006 Lin
7,128,603 B2 10/2006 Burris et al.
7,128,605 B2 10/2006 Montena
7,131,867 B1 11/2006 Foster et al.
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,300,309 B2 1/2007 Montena
7,179,121 B1 2/2007 Butts et al.
7,186,127 B2 3/2007 Montena
7,189,113 B2 3/2007 Sattele et al.
7,198,507 B2 4/2007 Tusini
7,207,820 B1 4/2007 Montena
7,229,303 B2 6/2007 Vermoesen et al.
7,241,172 B2 7/2007 Rodrigues et al.
7,252,546 B1 8/2007 Holland
7,255,598 B2 8/2007 Montena et al.
7,264,503 B2 9/2007 Montena
7,299,520 B2 11/2007 Huang
7,299,550 B2 11/2007 Montena
7,309,255 B2 12/2007 Rodrigues
7,354,309 B2 4/2008 Palinkas
7,371,112 B2 5/2008 Burris et al.
7,371,113 B2 5/2008 Burris et al.
7,375,533 B2 5/2008 Gale
7,393,245 B2 7/2008 Palinkas et al.
7,404,737 B1 7/2008 Youtsey
7,442,081 B2 10/2008 Burke et al.
7,452,237 B1 11/2008 Montena
7,452,239 B2 11/2008 Montena
7,455,549 B2 11/2008 Rodrigues et al.
7,455,550 B1 11/2008 Sykes
7,462,068 B2 12/2008 Amidon
7,476,127 B1 1/2009 Wei
7,479,033 B1 1/2009 Sykes et al.
7,479,035 B2 1/2009 Bence et al.
7,480,991 B2 1/2009 Khemakhem et al.
7,488,210 B1 2/2009 Burris et al.
7,494,355 B2 2/2009 Hughes et al.
7,497,729 B1 3/2009 Wei
7,507,117 B2 3/2009 Amidon
7,513,795 B1 4/2009 Shaw
7,544,094 B1 6/2009 Paglia et al.
7,566,236 B2 7/2009 Malloy et al.
7,568,945 B2 8/2009 Chee et al.
7,607,942 B1 10/2009 Van Swearingen
7,644,755 B2 1/2010 Stoesz et al.
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,792,148 B2 9/2010 Carlson et al.
7,794,275 B2 9/2010 Rodrigues
7,798,849 B2 9/2010 Montena
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,828,596 B2 11/2010 Malak
7,830,154 B2 11/2010 Gale
7,833,053 B2 11/2010 Mathews
7,837,501 B2 11/2010 Youtsey
7,845,963 B2 12/2010 Gastineau
7,845,976 B2 12/2010 Mathews
7,845,978 B1 12/2010 Chen
7,845,980 B1 * 12/2010 Amidon ..... H01R 13/5219 439/578
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,927,135 B1 4/2011 Wlos
7,934,954 B1 5/2011 Chawgo et al.
7,950,958 B2 5/2011 Mathews
7,955,126 B2 6/2011 Bence et al.
7,972,158 B2 7/2011 Wild et al.
8,029,315 B2 10/2011 Purdy et al.
8,033,862 B2 10/2011 Radzil et al.
8,062,044 B2 11/2011 Montena et al.
8,062,063 B2 11/2011 Malloy et al.
8,075,337 B2 12/2011 Malloy et al.
8,075,338 B1 12/2011 Montena
8,079,860 B1 12/2011 Zraik
8,113,875 B2 2/2012 Malloy et al.
8,152,551 B2 4/2012 Zraik
8,157,588 B1 4/2012 Rodrigues et al.
8,157,589 B2 4/2012 Krenceski et al.
8,167,635 B1 5/2012 Mathews
8,167,636 B1 * 5/2012 Montena ..... H01R 9/0527 439/322
8,167,646 B1 5/2012 Mathews
8,172,612 B2 5/2012 Bence et al.
8,186,919 B2 5/2012 Blair
8,192,237 B2 6/2012 Purdy et al.
8,231,406 B2 7/2012 Burris et al.

(56) References Cited

U.S. PATENT DOCUMENTS

| | | | |
|---|---|---|---|
| 8,231,412 | B2 | 7/2012 | Paglia et al. |
| 8,287,320 | B2 | 10/2012 | Purdy et al. |
| 8,313,345 | B2 | 11/2012 | Purdy |
| 8,313,353 | B2 | 11/2012 | Purdy et al. |
| 8,323,053 | B2 | 12/2012 | Montena |
| 8,323,060 | B2 | 12/2012 | Purdy et al. |
| 8,328,577 | B1 | 12/2012 | Yueh Chiung et al. |
| 8,337,229 | B2 | 12/2012 | Montena |
| 8,366,481 | B2 | 2/2013 | Ehret et al. |
| 8,376,769 | B2 | 2/2013 | Holand et al. |
| 8,382,517 | B2 | 2/2013 | Mathews |
| 8,398,421 | B2 | 3/2013 | Haberek et al. |
| 8,414,322 | B2 | 4/2013 | Montena |
| 8,444,445 | B2 | 5/2013 | Amidon et al. |
| 8,469,739 | B2 * | 6/2013 | Rodrigues ..... H01R 13/622 439/578 |
| 8,469,740 | B2 | 6/2013 | Ehret et al. |
| 8,475,205 | B2 | 7/2013 | Ehret et al. |
| 8,480,430 | B2 | 7/2013 | Ehret et al. |
| 8,480,431 | B2 | 7/2013 | Ehret et al. |
| 8,485,845 | B2 | 7/2013 | Ehret et al. |
| 8,348,697 | B2 | 8/2013 | Zraik |
| 8,506,325 | B2 | 8/2013 | Malloy et al. |
| 8,517,763 | B2 | 8/2013 | Burris et al. |
| 8,529,279 | B2 | 9/2013 | Montena |
| 8,562,366 | B2 | 10/2013 | Purdy et al. |
| 8,597,041 | B2 | 12/2013 | Purday et al. |
| 2002/0013088 | A1 | 1/2002 | Rodrigues et al. |
| 2002/0038720 | A1 | 4/2002 | Kai et al. |
| 2003/0068924 | A1 | 4/2003 | Montena |
| 2003/0214370 | A1 | 11/2003 | Allison et al. |
| 2003/0224657 | A1 | 12/2003 | Malloy |
| 2004/0013096 | A1 | 1/2004 | Marinier et al. |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2006/0166552 | A1 | 7/2006 | Bence et al. |
| 2006/0205272 | A1 | 9/2006 | Rodgrguies |
| 2006/0276079 | A1 | 12/2006 | Chen |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0192674 | A1 | 8/2008 | Wang et al. |
| 2008/0225783 | A1 | 9/2008 | Wang et al. |
| 2008/0248689 | A1 | 10/2008 | Montena |
| 2008/0289470 | A1 | 11/2008 | Aston |
| 2009/0017803 | A1 | 1/2009 | Brilhart et al. |
| 2009/0029590 | A1 | 1/2009 | Sykes et al. |
| 2009/0098770 | A1 | 4/2009 | Bence et al. |
| 2009/0176396 | A1 | 7/2009 | Mathews |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy |
| 2010/0279548 | A1 | 11/2010 | Montena et al. |
| 2010/0297871 | A1 | 11/2010 | Haube |
| 2010/0297875 | A1 | 11/2010 | Purdy et al. |
| 2011/0021072 | A1 | 1/2011 | Purdy |
| 2011/0027039 | A1 | 2/2011 | Blair |
| 2011/0053413 | A1 | 3/2011 | Mathews |
| 2011/0086543 | A1 | 4/2011 | Alrutz |
| 2011/0111623 | A1 | 5/2011 | Burris et al. |
| 2011/0117774 | A1 | 5/2011 | Malloy et al. |
| 2011/0143567 | A1 | 6/2011 | Purdy et al. |
| 2011/0230089 | A1 | 9/2011 | Amidon et al. |
| 2011/0230091 | A1 | 9/2011 | Krenceski et al. |
| 2011/0250789 | A1 | 10/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0094530 | A1 | 4/2012 | Montena |
| 2012/0094532 | A1 | 4/2012 | Montena |
| 2012/0122329 | A1 | 5/2012 | Montena |
| 2012/0129387 | A1 | 5/2012 | Holland et al. |
| 2012/0145454 | A1 | 6/2012 | Montena |
| 2012/0196476 | A1 | 8/2012 | Haberek et al. |
| 2012/0202378 | A1 | 8/2012 | Krenceski et al. |
| 2012/0214342 | A1 | 8/2012 | Mathews |
| 2012/0222302 | A1 | 9/2012 | Purdy et al. |
| 2012/0225581 | A1 | 9/2012 | Amidon et al. |
| 2012/0252263 | A1 | 10/2012 | Ehret et al. |
| 2012/0270441 | A1 | 10/2012 | Bence et al. |
| 2013/0034983 | A1 | 2/2013 | Purday et al. |
| 2013/0065433 | A1 | 3/2013 | Burris |
| 2013/0065435 | A1 | 3/2013 | Purdy et al. |
| 2013/0072059 | A1 | 3/2013 | Purday et al. |
| 2013/0102188 | A1 | 4/2013 | Montena |
| 2013/0102189 | A1 | 4/2013 | Montena |
| 2013/0102190 | A1 | 4/2013 | Chastain et al. |
| 2013/0164975 | A1 | 6/2013 | Blake et al. |
| 2013/0171869 | A1 | 7/2013 | Chastain et al. |
| 2013/0171870 | A1 | 7/2013 | Chastain et al. |
| 2013/0183857 | A1 | 7/2013 | Ehret et al. |
| 2013/0337683 | A1 | 12/2013 | Chastain et al. |
| 2014/0051285 | A1 | 7/2014 | Raley et al. |

FOREIGN PATENT DOCUMENTS

| | | | |
|---|---|---|---|
| CN | 201149936.00 | Y | 11/2008 |
| CN | 201149937.00 | Y | 11/2008 |
| CN | 201178228.00 | Y | 1/2009 |
| CN | 201904508.00 | | 7/2011 |
| DE | 47931.00 | C | 10/1888 |
| DE | 102289.00 | C | 4/1899 |
| DE | 1117687.00 | B | 11/1961 |
| DE | 1191880.00 | | 4/1965 |
| DE | 1515398.00 | B1 | 4/1970 |
| DE | 2225764.00 | A1 | 12/1972 |
| DE | 2221936.00 | A1 | 11/1973 |
| DE | 2261973.00 | A1 | 6/1974 |
| DE | 3211008.00 | A1 | 10/1983 |
| DE | 9001608.40 | U1 | 4/1990 |
| DE | 4439852.00 | A1 | 5/1996 |
| DE | 19957518.00 | A1 | 9/2001 |
| EP | 116157.00 | A1 | 8/1984 |
| EP | 167738.00 | A2 | 1/1986 |
| EP | 0072104 | A1 | 2/1986 |
| EP | 0265276 | A2 | 4/1988 |
| EP | 0428424 | A2 | 5/1991 |
| EP | 1191268.00 | A1 | 3/2002 |
| EP | 1501159.00 | A1 | 1/2005 |
| EP | 1548898.00 | A1 | 6/2005 |
| EP | 1701410.00 | A2 | 9/2006 |
| FR | 2232846.00 | A1 | 1/1975 |
| FR | 2234680.00 | A2 | 1/1975 |
| FR | 2312918.00 | | 12/1976 |
| FR | 2462798.00 | A1 | 2/1981 |
| FR | 2494508.00 | A1 | 5/1982 |
| GB | 589697.00 | A | 6/1947 |
| GB | 1087228.00 | A | 10/1967 |
| GB | 1270846.00 | A | 4/1972 |
| GB | 1401373.00 | A | 7/1975 |
| GB | 2019665.00 | A | 10/1979 |
| GB | 2079549.00 | A | 1/1982 |
| GB | 2252677.00 | A | 8/1992 |
| GB | 2264201.00 | A | 8/1993 |
| GB | 2331634.00 | A | 5/1999 |

(56) References Cited

FOREIGN PATENT DOCUMENTS

| | | | |
|---|---|---|---|
| GB | 2477479.00 | | 8/2010 |
| JP | 3074864.00 | | 1/2001 |
| JP | 2002-015823 | | 1/2002 |
| JP | 4503793.00 | B9 | 1/2002 |
| JP | 2002075556.00 | A | 3/2002 |
| JP | 2001102299.00 | | 4/2002 |
| JP | 3280369.00 | B2 | 5/2002 |
| KR | 2006100622526.00 | B1 | 9/2006 |
| TW | 427044.00 | B | 3/2001 |
| WO | 8700351.00 | | 1/1987 |
| WO | 0186756 | A1 | 11/2001 |
| WO | 2069457.00 | A1 | 9/2002 |
| WO | 2004013883.00 | A2 | 2/2004 |
| WO | 2006081141.00 | A1 | 8/2006 |
| WO | 2010135181.00 | | 11/2010 |
| WO | 2011128665.00 | A1 | 10/2011 |
| WO | 2011128666.00 | A1 | 10/2011 |
| WO | 2012061379.00 | A2 | 5/2012 |

OTHER PUBLICATIONS

ISR1; PCT/US2011/057939 dated Apr. 30, 2012 International Search Report and Written Opinion. pp. 8.

LIT10; Defendant's Disclosure of Preliminary Invalidity Contentions, Served Oct. 31, 2013, *PPC Broadband, Inc. d/b/a PPC* v. *Times Fiber Communications, Inc.*, United States District Court Northern district of New York, Civil Action No. 5:13-CV-0460-TJM-DEP, 48 pages.

LIT12a; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert, Inc.*, United States District Court Northern District of New York, Civil Action No. 5:12-CV-00911-GLS-DEP, pp. 1-90.

LIT12b; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert, Inc.*, United States District Court Northern District of New York, Civil Action No. 5:12-CV-00911-GLS-DEP, pp. 91-199.

LIT12c; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert, Inc.*, United States District Court Northern District of New York, Civil Action No. 5:12-CV-00911-GLS-DEP, pp. 200-383.

LIT16; Report and Recommendation, Issued Dec. 5, 2013, *John Mezzalingua Associates, Inc., d/b/a PPC*, v. *Corning Gilbert, Inc.*, United States District Court Northern District of New York, Civil Action No. 5:12-CV-00911-GLS-DEP, 52 pages.

NOA1; Notice of Allowance (dated Feb. 24, 2012) for U.S. Appl. No. 13/033,127, filed Feb. 23, 2011.

NOA2; Notice of Allowance (dated Jan. 24, 2013) for U.S. Appl. No. 13/072,350.

NOA3; Notice of Alowance (dated Jun. 25, 2012) for U.S. Appl. No. 12/633,792, filed Dec. 8, 2009.

NOA4; Notice of Allowance (dated Mar. 20, 2012) for U.S. Appl. No. 13/117, 843, filed May 27, 2011.

OA1; Office Action dated Mar. 29, 2013 for U.S. Appl. No. 13/712,470.

OA10; Final Office Action (dated Oct. 25, 2011) for U.S. Appl. No. 13/033,127, filed Feb. 23, 2011.

OA11; Office Action (dated Oct. 24, 2011) for U.S. Appl. No. 12/633,792, filed Dec. 8, 2009.

OA2; Office Action (dated Mar. 6, 2013) for U.S. Appl. No. 13/726,330, filed Dec. 24, 2012.

OA3; Office Action (dated Feb. 20, 2013) for U.S. Appl. No. 13/726,349, filed Dec. 24, 2012.

OA4; Office Action (dated Feb. 20, 2013) for U.S. Appl. No. 13/726,339, filed Dec. 24, 2012.

OA5; Office Action (dated Mar. 11, 2013) for U.S. Appl. No. 13/726,347, filed Dec. 24, 2012.

OA6; Office Action (dated Feb. 20, 2013) for U.S. Appl. No. 13/726,356, filed Dec. 24, 2012.

OA7; Office Action (dated Apr. 12, 2013) for U.S. Appl. No. 13/712,498, filed Dec. 12, 2012.

OA8; Office Action (dated Jun. 11, 2013) for U.S. Appl. No. 13/860,964, filed Apr. 11, 2013.

OA9; Office Action (dated Jun. 2, 2011) for U.S. Appl. No. 13/033,127, filed Feb. 23, 2011.

REEXAM1; U.S. Reexamination Control No. 90/012,300 of U.S. Pat. No. 8,172,612, filed Jun. 29, 2012.

RES1; Response dated Jun. 24, 2011 to Office Action (dated Jun. 2, 2011) for U.S. Appl. No. 13/033,127, filed Feb. 23, 2011.

TECHDOC1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.

TECHDOC10; PPC Product Guide, 2008.

TECHDOC2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.

TECHDOC3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.

TECHDOC4; Panasonic, "Remaining issues on Persistent scheduling," R2-083311, derived from R2-082228 and R2-082229, Agenda Item: 6.1.1.8, 3GPP TSG RAN WG2 #62bis, Warsaw, Poland, Jun. 30-Jul. 4, 2008, 4 pages.

TECHDOC5; Qualcomm Europe, "Release of semi-persistent resources," R2-082500 (was R2-081828), Agenda Item: 5.1.1.8 3GPP TSG-RAN WG2 meeting #62, Kansas City, MO, USA, May 5-9, 2008, 2 pages.

TECHDOC6; Samsung, "C-RNTI and NDI for SPS," R2-084464, Agenda Item: 6.1.1.3, 3GPP TSG-RAN2#63 meeting, Jeju, South Korea, Aug. 18-22, 2008, 3 pages.

TECHDOC7; Nokia Corporation, Nokia Siemens Networks, "Persistent Scheduling for DL," R2-080683 (RS-080018), 3GPP TSG-RAN WG2 Meeting #61, Agenda Item: 5.1.1.8, Sorrento, Italy, Feb. 11-15, 2008, 6 pages.

TECHDOC8; Panasonic, "SPS activation and release," R1-084233, 3GPP TSG-RAN WG1 Meeting #55, Prague, Czech Republic, Nov. 10-14, 2008, 6 pages.

TECHDOC9; PCT International, Inc., Compression Connectors Installation Guide, Aug. 3, 2009.

TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens, Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.

TECHSPEC1A; "3rd Generation Partnership Project; Technical Specification Group Radio Access Network; Requirements for Evolved UTRA (E-UTRA) and Evolved UTRAN (E-UTRAN) (Release 7)," Technical Report, 3GPP TR 125.913 V7.3.0, Mar. 2006, 18 pages.

TECHSPEC2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2 (Release 8)," Technical Specification, 3GPP TS 36.300 V8.5.0, May 2008, 134 pages.

TECHSPEC3A; "3rd Generation Partnership Project; Technical Specification Group Radio Access Network; Evolved Universal Terrestrial Radio Access (E-UTRA) Medium Access Control (MAC) protocol specification (Release 8)," Technical Specification, 3GPP TS 36.321 V8.2.0, May 2008, 32 pages.

TECHSPEC4A; "3rd Generation Partnership Project; Technical Specification Group Radio Access Netowrk; Evolved Universal

(56) References Cited

OTHER PUBLICATIONS

Terrestrial Radio Access (E-UTRA); Physical layer procedures (Release 8)," Technical Specification, 3GPP TS 36.213 V8.4.0, Sep. 2008, 60 pages.
TECHSPEC5A; Society of Cable Telecommunications Engineers, Engineering Committee, Interface Practices Subcommittee; American National Standard; ANSI/SCTE 01 2006; "Specification for "F" Port, Female, Outdoor". Published Jan. 2006. 9 pages.
TECHSPEC6A; Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
Inter Partes Reexamination of U.S. Pat. No. 8,192,237 (Control No. 95/002,400).
Inter Partes Review Case IPR2013-00340—U.S. Pat. No. 8,323,060 (Claims 1-9).
Inter Partes Review Case IPR2013-00342—U.S. Pat. No. 8,323,060 (Claims 10-25).
Inter Partes Review Case IPR2013-00343—U.S. Pat. No. 8,313,353 (Claims 1-6).
Inter Partes Review Case IPR2013-00345—U.S. Pat. No. 8,313,353 (Claims 7-27).
Inter Partes Review Case IPR2013-00346—U.S. Pat. No. 8,287,320 (Claims 1-8, 10-16, and 18-31).
Inter Partes Review Case IPR2013-00347—U.S. Pat. No. 8,287,320 (Claims 9, 17, and 32).
Patent Application No. GB1109575.9 Examination Report Under Section 18(3); Date of Report: Jun. 23, 2011. 3 pp.
Patent No. ZL2010202597847; Evaluation Report of Utility Model Patent; Date of Report: Sep. 2, 2011. 8 pages. (Chinese version with English Translation (10 pages) provided).
PCT/US2010/034870; International Filing Date May 14, 2010. International Search Report and Written Opinion. dated Nov. 30, 2010. 7 pages.
Request for Inter Partes Reexamination (filed Sep. 13, 2012) of Purdy et al. U.S. Pat. No. 8,192,237 issued Jun. 5, 2012. 150 pages.
U.S. Reexamination Control No. 90/012,749 of U.S. Pat. No. 7,114,990, filed Dec. 21, 2012.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-C4. 122 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,366,481. 96 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,469,740. 78 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,475,205. 236 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,430. 189 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,431. 73 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,485,845. 73 pages.
LIT8_Appendix_ABC; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendices A, B and C, Dated Nov. 19, 2012. 55 pages.
LIT8_Appendix_D; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix D, Dated Nov. 19, 2012. 108 pages.
LIT8_Appendix_E1; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 1-90 pages.
LIT8_Appendix_E2; *John Mezzalingua Associates, Inc., d/b/a PPC*, v. *Corning Gilbert, Inc.*, USDC, Northern District of New York, Case No. 5:12-Cv-00911-GLS-DEP, Defendant Corning Gilbert Inc.'s Disclosure of Non-Infringement, Invalidity, and Unenforceability Contentions with Appendix E, Dated Nov. 19, 2012. 91-182 pages.
LIT8_Appendix_E3; *John Mezzalingua Associates, Inc., d/b/a PPC*, v. *Corning Gilbert, Inc.*, USDC, Northern District of New York, Case No. 5:12-Cv-00911-GLS-DEP, Defendant Corning Gilbert Inc.'s Disclosure of Non-Infringement, Invalidity, and Unenforceability Contentions with Appendix E, Dated Nov. 19, 2012. 183-273 pages.
LIT8_Appendix_E4; *John Mezzalingua Associates, Inc., d/b/a PPC*, v. *Corning Gilbert, Inc.*, USDC, Northern District of New York, Case No. 5:12-Cv-00911-GLS-DEP, Defendant Corning Gilbert Inc.'s Disclosure of Non-Infringement, Invalidity, and Unenforceability Contentions with Appendix E, Dated Nov. 19, 2012. 274-364 pages.
LIT8_Appendix_E5; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 365-450 pages.
LIT8_Appendix_E6; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 451-483 pages.
LIT8_Appendix_E7; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 33 pages.
LIT8_CG_Infringement; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendices, Dated Nov. 19, 2012. 20 pages.

(56) References Cited

OTHER PUBLICATIONS

LIT8_Ex1-23; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions, Exhibits 1-23, Dated Nov. 19, 2012. 229 pages.
LIT8_Ex24-45; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions, Exhibits 24-45, Dated Nov. 19, 2012. 200 pages.

* cited by examiner 58
56
22
16
14
54
P
60
18
48
46
C
J
44
36
38
10
B
32
12
52
50
22
16

15
70

70
56
22
15
5
70

70
56
72
5
72
15

56
80
82

52
22
56

52
80
15
9

80
56
82
9

GROUNDING MEMBER FOR COAXIAL CABLE CONNECTOR

CROSS-REFERENCE TO RELATED PATENT APPLICATIONS

This application is a continuation of, and claims the benefit and priority of U.S. Non-Provisional patent application Ser. No. 14/920,150, filed on Oct. 22, 2015, entitled "BAND SPRING CONTINUITY MEMBER FOR COAXIAL CABLE CONNECTOR" which is a continuation-in-part of, and claims the benefit and priority of, U.S. Non-Provisional patent application Ser. No. 13/479,123, filed on May 23, 2012, entitled "COAXIAL CABLE CONNECTOR WITH CONDUCTIVE SEAL" which claims the benefit of U.S. Provisional Patent Application Ser. No. 61/490,373, filed on May 26, 2011. The entire contents of such applications are hereby incorporated by reference in their entirety.

BACKGROUND

The present disclosure relates to cable connectors; and more particularly, to a new and improved connector for connecting a coaxial cable to a RF device, such as, a home entertainment system, television set, or other device.

SUMMARY

The present disclosure is directed to a connector including a post, a sleeve or body member, and a coupling member each having a flange member. The flange members of the sleeve and coupling member have recesses each defining an internal contact surface separated by an axial gap. The connector also includes an arcuate bridge member radially biased outwardly against at least one of the internal contact surfaces and spanning the axial gap. The arcuate bridge member maintains an electrical ground path across the axial gap even when the sleeve does not electrically contact the coupling member.

Another embodiment of the connector relates to a coaxial cable connector wherein the recesses include at least one conical surface which is responsive to a radially biased conductive bridge member to produce a radial force against the internal contact surfaces such that an axial force component is generated along the conical surface. The conductive bridge member spans the axial gap so as to maintain an electrical ground path across the axial gap even when the sleeve does not electrically contact the coupling member. Furthermore, the conductive bridge member constantly biases the flange of the coupling member against the flange of the post to urge the post against an interface port.

In one embodiment the conductive bridge member is an arcuate bridge member having an outwardly directed contact surface complementing the conical surface of the internal contact surface. In another embodiment, the conductive bridge member is a coil spring having a diameter dimension which is oversized relative to the size of the recesses such that when the connector is in an assembled state, the coil spring deforms radially such that an axial component of force is produced. Specifically, the axial component is produced by the interaction of the coil spring with the conical surface of the coupling member.

Another embodiment relates to a coaxial cable connector wherein a sealing member is disposed between the flange of the post and the inwardly directed flange of the coupling member.

BRIEF DESCRIPTION OF THE DRAWINGS

The present disclosure will become more readily appreciated and understood from consideration of the following detailed description of various embodiments of the present invention when taken together with the accompanying drawings, in which.

DETAILED DESCRIPTION

Various embodiments disclosed herein provide for a novel and improved compression connector for cables, and specifically, for coaxial cables. For example, in F-connectors designed specifically for connection to a port or terminal of an entertainment or security system, an electrically conductive, watertight seal is disclosed herein for use in combination with an annular coupling member to maintain optimum electrical conductivity between the coaxial cable and port. In one embodiment, an electrically conductive seal is in the form of a rubber or resilient O-ring containing electrically conductive particles and is mounted so as to be compressible between a port and the end of the cable connector.

In another embodiment, a conductive spring is utilized in combination with an elastomeric seal and a spring mounted between opposing or confronting surface portions of an outer connector sleeve and a coupling member. In still another embodiment, a conductive spring in the form of an arcuate band is mounted between the opposing or confronting surface portions of the connector sleeve and coupling member, but spaced or removed away from the seal member.

Coaxial cables often include inner and outer concentric conductors separated by a dielectric insulator and encased or covered by an outer jacket of a rubber-like material. Numerous end connectors have been devised to effect a secure mechanical and electrical connection between a connector assembly (e.g., a coaxial cable connector) and the end of the coaxial cable, typically by having the inner conductor and dielectric insulator extend through an inner sleeve of the connector assembly while the outer conductor and jacket are inserted into an annular space between the inner sleeve and an outer sleeve. The outer sleeve is then crimped in a radially inward direction or otherwise compressed, etc. to securely clamp the end of the cable within the connector, and a fastener such as a nut on the opposite end of the connector is then connected to a port or terminal.

U.S. Pat. No. 5,975,949 illustrates a coaxial cable connector of the type described and with a somewhat modified form of watertight seal which is interposed between confronting surface portions of a flange at the end of the inner sleeve and the end of a coupling member which extends from the post or terminal. Nevertheless, in certain applications, there is a continuing need for a compression-type coaxial cable and connector which can achieve improved mechanical and electrical connection between the coaxial cable connector and the port or terminal including a novel and improved watertight but electrically conductive seal which will maintain the necessary conductivity and which is mounted in such a way as to resist accidental loosening of the coupling member between the connector and port or terminal.

Figures 1, 2, 3:
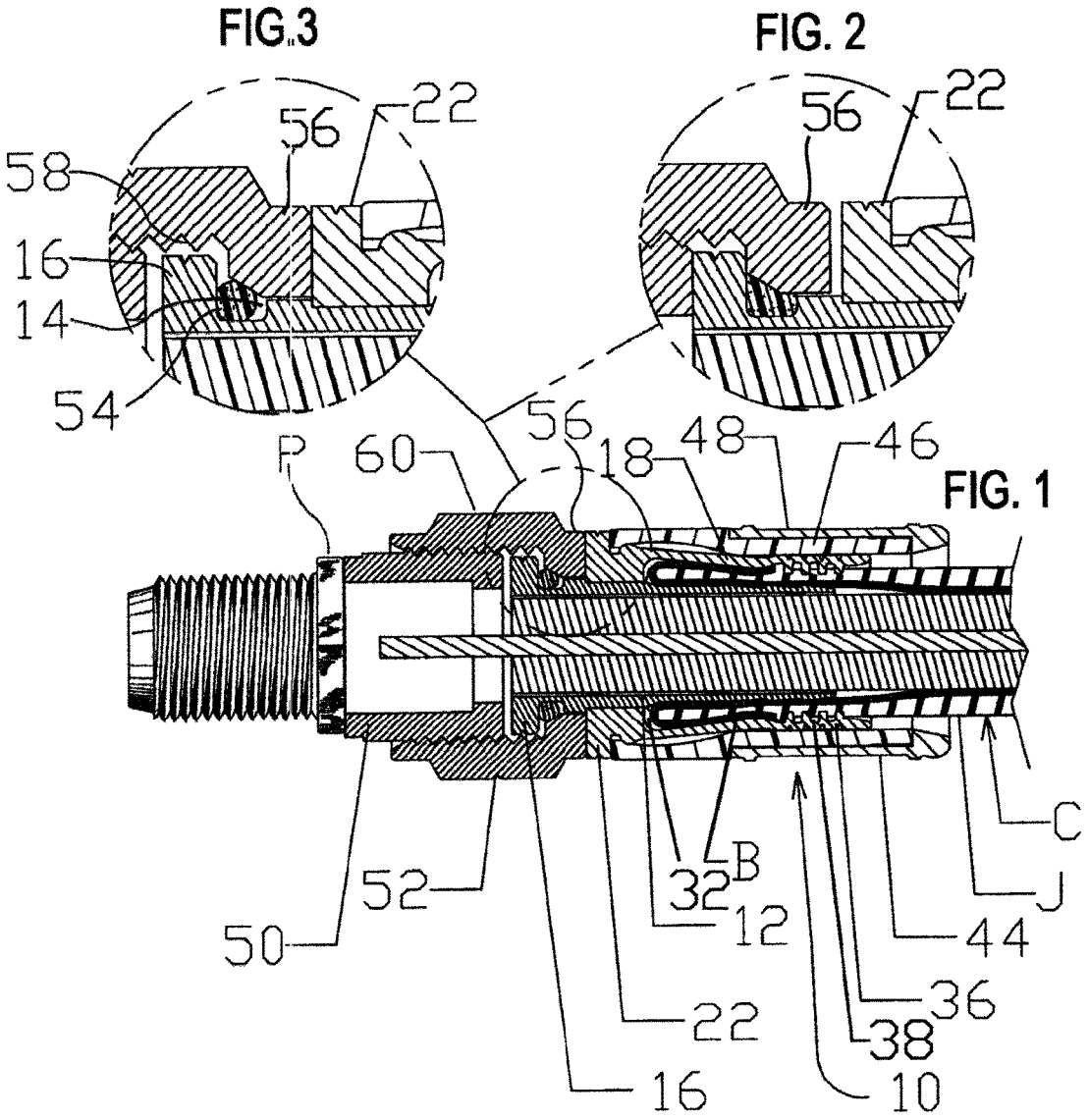
FIG. 1 is a longitudinal section view of one embodiment with a cable and seal in a loosely assembled position.
FIG. 2 is an enlarged view in section of the conductive seal of FIG. 1 in a loosely assembled position prior to installation according to an exemplary embodiment.
FIG. 3 is another enlarged sectional view in detail of the conductive seal of FIG. 1 in a fully tightened position according to an exemplary embodiment.

Referring in more detail to the drawings, one embodiment is illustrated in FIGS. 1 to 3 wherein the assembly is made up of a connector 10 for connecting a first electrically conductive bridge member, such as, a standard coaxial cable C to a second electrically conductive member, such as, a port or terminal P on different components of a home entertainment system, etc. According to an exemplary embodiment, connector 10 includes an elongated thin-walled inner sleeve 12 or post at an entrance end. In some embodiments, sleeve 12 increases in thickness along a mid-portion into an external groove 14 and terminates in an external shoulder 16. Connector 10 further includes an outer thin-walled sleeve 18 extending from a point slightly beyond the sleeve 12 at the entrance end, and in some embodiments being of uniform thickness along its greater length. Sleeve 18 may be provided with an external groove which is flanked at one end by external shoulder 22.

In one embodiment, inner and outer sleeves 12 and 18 extend rearwardly from the entrance end in spaced concentric relation to one another so as to form an annular space 32 therebetween for insertion of a standard cable C in a manner to be described. Inner sleeve 12 may be of substantially uniform wall thickness for its greater length and have a plurality of axially spaced, annular serrations along its outer wall surface and toward the entrance end. Outer sleeve 18 may be thin-walled along its greater length, but gradually increases in thickness to define an external convex surface portion 36 and which has a plurality of axially spaced sealing rings or grooves 38 in accordance with U.S. Pat. No. 5,501,616.

According to an exemplary embodiment, a crimping ring 44 (compression member, etc.) of generally cylindrical configuration may be configured to extend over at least a portion of outer sleeve 18, and may have a length generally corresponding to the length of the thin-walled sections of outer sleeve 18. In some embodiments, member 44 includes an inner liner 46 that may be of uniform thickness and diameter throughout which terminates in opposed beveled ends, and an outside band 48 that may be of generally uniform thickness and diameter throughout at least a portion of its length and may be coextensive with inner liner 46. In some embodiments, inner liner 46 is composed of a material having a slight amount of give or resilience; and outer band 48 is composed of a material having little or no give or compressibility, such as, a brass material. Inner liner 46 and band 48 may in some embodiments be of substantially corresponding thickness, and inner liner 46 may be mounted in a press-fit or other fashion inside of band 48, with its inner wall surface being of a diameter corresponding to or slightly greater than the outer diameter of outer sleeve 18 at its entrance end. Inner liner 46 may in some embodiments have an inner diameter less than the convex surface portion 36 on outer sleeve 18 so that when ring 44 is axially advanced, ring 44 will impart inward radial deformation to the convex surface portion of outer sleeve 18 causing it to be contracted, as illustrated in FIG. 1, into engagement with the cable C.

The cable C is connected to the connector 10 in the usual manner by first preparing the leading end of the cable to fold the braided layer B over the end of the jacket J, as illustrated in FIG. 1. Compression ring 44 is aligned, as illustrated in FIG. 1, with the end of connector 10, following which the leading end of cable C is advanced through compression ring 44 and into annular space 32 formed between inner sleeve 12 and outer sleeve 18. A standard compression tool may be used to impart sufficient axial force to advance compression ring 44 over convex surface portion 36 to radially deform or contract that portion of sleeve 18 inwardly, and portion 36 will be bowed or deformed, etc. in a radially inward direction, as shown in FIG. 1, and cause jacket J, as well as at least a portion of braided layer B, to be compressed slightly between inner and outer sleeves 12 and 18.

Once the installation is completed, a starter guide, if used, may be removed from the end of the pin conductor and discarded. A compression tool (not shown) is shown and described in detail in U.S. Pat. No. 6,708,396 which is incorporated by reference herein. While the Figures herein generally show a compression member moving axially over a compressible outer sleeve to secure a coaxial cable relative to the coaxial connector, other forms of securing the cable may be used, such as a deformable locking sleeve being axially compressed within a connector body to similarly secure the coaxial cable in position. All such alternative embodiments are to be understood to be within the scope of the present disclosure.

Port or terminal P may have a hollow externally threaded extension 50 to receive the inner conductor pin of the cable C and is coupled to the end of the connector 10 by a coupling member, such as, a nut 52 which is internally threaded with threads 58 to mate with the external threading on extension 50 whereby to draw extension 50 toward and/or into engagement with flange 16 on the end of inner sleeve or post 12 of connector 10. In order to provide for improved conductivity between connector 10 and port P, and in particular to maintain the necessary conductivity notwithstanding a poor connection or loosening of the coupling members between the conductor pin and port P, an electrically conductive, watertight annular seal 54 (e.g., a conductive O-ring, resilient member, elastomeric member, etc.) may mounted in a groove 14 adjacent to flange 16 and coupling member 52.

Coupling member 52 may extend forwardly from an end wall 56 over and beyond flange 16, and may be internally threaded to facilitate connection to extension 50 of the port P. Exterior surface 60 of coupling member 52 may be provided with suitable flats (e.g., a generally hexagonal configuration, etc.) for engagement by a wrench or other suitable tool to rotate coupling member 52 independently from the remainder of connector 10.

According to an exemplary embodiment, seal 54 may take the form of an O-ring, and may be composed of an elastomeric material having electrically conductive particles uniformly or non-uniformly distributed within seal 54, one example of such particles being carbon fibers. In the loosely assembled position shown in FIGS. 1 and 3, seal 54 is in a relaxed state and not necessarily in direct contact with the adjacent or confronting surfaces of the flange 16 and end wall 56 of the coupling member 52. However, when the coupling member 52 is rotated to draw the port into contacting relation to the forward end of flange 16 opposite to seal 54, end wall 56 will be drawn toward the opposite surface of flange 16 to compress the seal 54 between the end wall 56 and flange 16, as shown in detail in FIGS. 2 and 3. As a result, a conductive path is established between inner sleeve 12 and end wall 56 of coupling member 52.

It will be appreciated that seal 54 will maintain the necessary contacting relationship between the confronting surfaces notwithstanding a slight loosening between the parts, such as, as a result of temperature changes or wear. An important advantage of utilizing a watertight, conductive seal as one member or unit is that it serves a dual function of providing a watertight seal which is also electrically conductive; and at the same time the seal diameter may be varied to compensate for differences in connector size and the gap between the confronting surfaces of flange 16 and end wall 56, as well as variations in type of connector.

FIGS. 4-7 illustrate another embodiment of an electrically conductive compressible member in the form of a coil spring 70, which may be mounted under compression in a recessed area or gap 72 between end wall 56 and external shoulder 22 at an end of outer sleeve 18 of connector 10, as illustrated in FIGS. 4-7. According to an exemplary embodiment, shoulder 22 has a squared end surface in normally abutting relation to a squared end surface on end wall 56 of coupling member 52. In some embodiments, rather than to replace a standard O-ring seal 15, spring coil 70 may be mounted under compression within the complementary recessed portions that define gap 72 between the respective confronting surface portions of end wall 56 of coupling member 52 and shoulder 22 of outer sleeve 18.

Figures 4, 5, 6, 7:
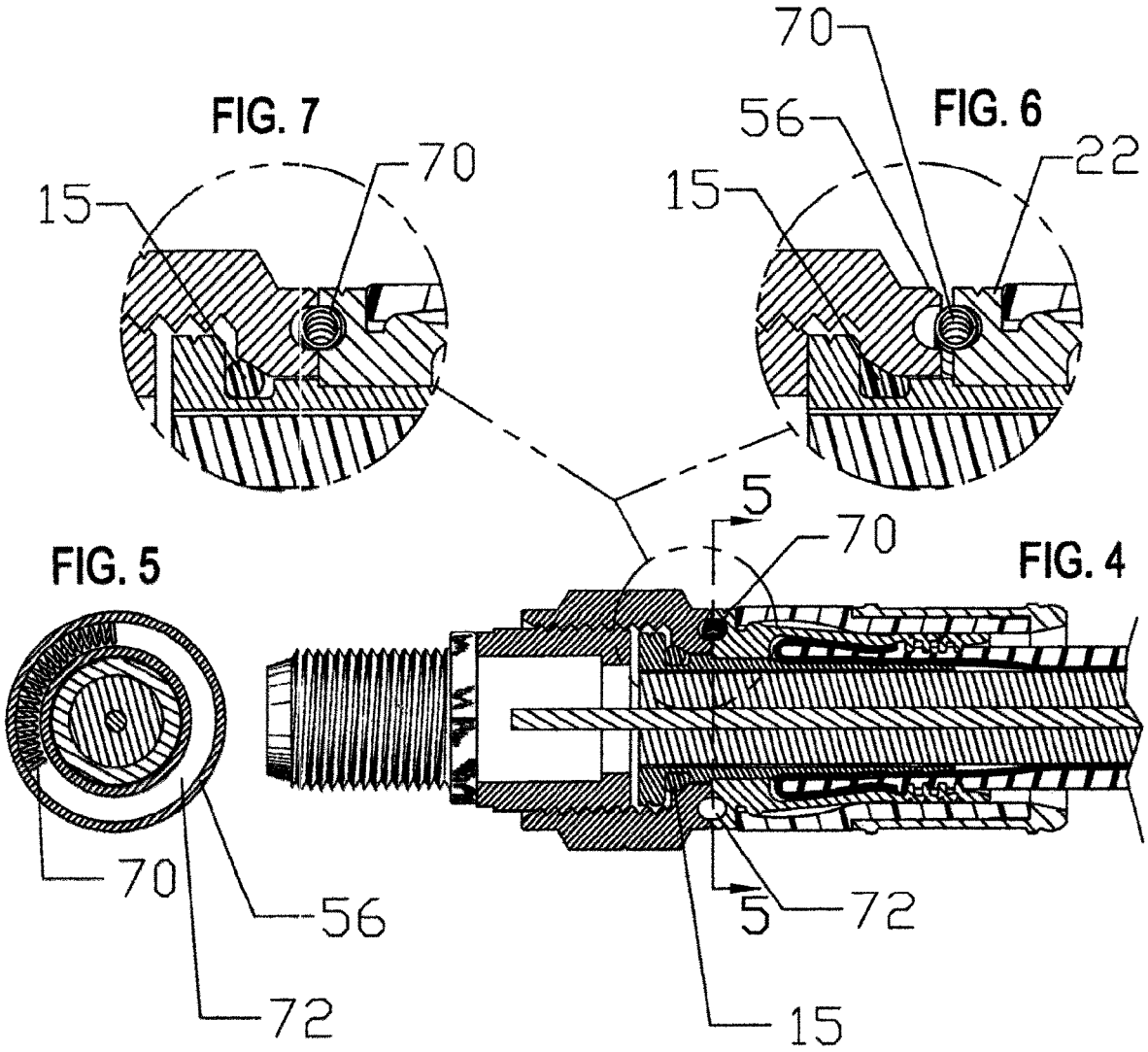
FIG. 4 is a longitudinal sectional view of another embodiment utilizing a conductive spring member and illustrating the cable in an assembled position.
FIG. 5 is a cross-sectional view taken about lines 5-5 of FIG. 4 according to an exemplary embodiment.
FIG. 6 is an enlarged view in detail of the spring member of FIG. 4 shown in a tightly assembled position according to an exemplary embodiment.
FIG. 7 is another sectional view in detail of the spring member of FIG. 4 in a loosely assembled position according to an exemplary embodiment.

As best seen from the end view of FIG. 5, it is not necessary for the spring 70 to extend around the entire circumference of the connector body to maintain an electrical ground path between outer sleeve 18 and coupling member 52. However, spring 70 may be of a diameter and under sufficient compression to expand and to maintain electrical contact between sleeve 18 and coupling member 52 (e.g., between the confronting surfaces of sleeve 18 and coupling member 52) notwithstanding slight separation between them, for example, as shown in FIG. 6.

Figures 8, 9, 10, 11:
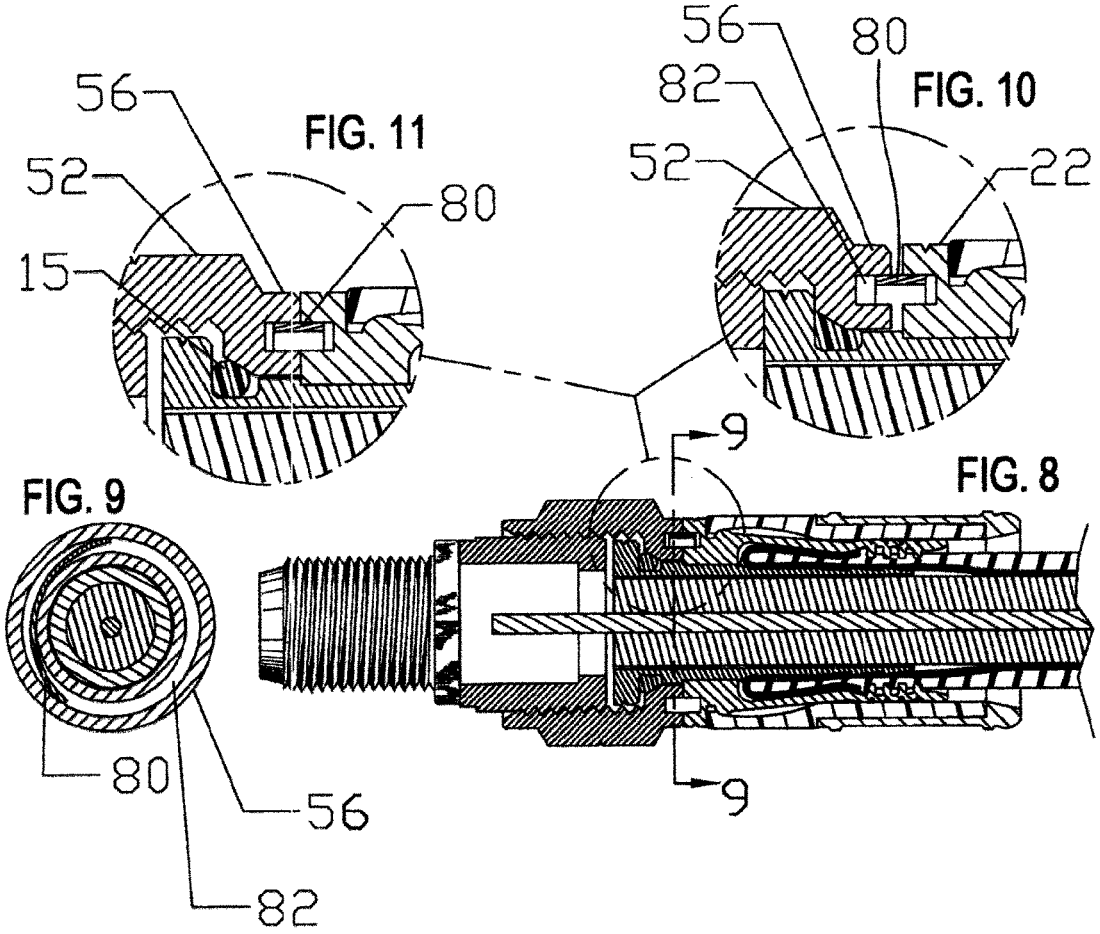
FIG. 8 is a longitudinal section view of still another embodiment utilizing a flat spring as a conductive bridge member and being shown in a fully assembled position.
FIG. 9 is a cross-sectional view taken about lines 9-9 of FIG. 8 according to an exemplary embodiment.
FIG. 10 is an enlarged sectional view in detail of the seal and spring in a tightly assembled position according to an exemplary embodiment.
FIG. 11 is another enlarged sectional view in detail of the seal and spring of FIG. 8 in a loosely assembled position according to an exemplary embodiment.

Another embodiment of a conductive ring is illustrated in FIGS. 8-10, wherein like parts to those of FIGS. 1-7 are correspondingly enumerated, and, in a manner similar to that described in connection with the embodiment of FIGS. 4-7, a spring-like, generally circular band 80 may be mounted in a gap 82 defined by annular recessed portions in facing relation to one another in external shoulder 22 of outer sleeve 18 and end wall 56 of coupling member 52. According to an exemplary embodiment, band 80 may be composed of a resilient electrically conductive material such as a metal which is normally flat, but when inserted into gap 82 may be bent, as illustrated In FIG. 9, so that opposite ends of band 80 yieldingly engage circumferentially spaced surface portions of the outer wall of gap 82, and an intermediate or central portion of band 80 is in contact with the inner wall of gap 82. Also, band 80 may be of a width sufficient to extend along a substantial portion of the width of gap 82. As illustrated in FIG. 10, in some embodiments, band 80 will maintain electrical conductivity between outer sleeve 18 and coupling member 52 notwithstanding separation between the components; and when member 52 is adjacent the end of the sleeve 18, as shown in FIG. 11, band 80 will traverse a substantial width of gap 82.

According to alternative embodiments, the conductive ring members 70 and 80 could be composed of various materials or composite materials which would offer the same characteristics of resiliency and conductivity. For example, one or both of members 70 and 80 could be composed of an inner matrix of plastic with an outer coating of a conductive material, such as, the carbon fibers referred to in connection with FIGS. 1-3. As in the case of helical spring member 70, band 80 does not have to extend throughout the entire annular gap, for example, as illustrated in FIG. 9. In this respect, band 80 would assume a somewhat arcuate configuration when inserted into the gap between the confronting surface portions of the shoulder 22 and end wall 56.

Although the different forms of connector sleeves are illustrated for use in F-connectors as in FIGS. 1 to 11, it will be apparent that they are readily conformable for use with other types of connectors, such as, but not limited to BNC and RCA connectors. It is therefore to be understood that while selected forms of invention are herein set forth and described, the above and other modifications may be made therein without departing from the spirit and scope of the invention as defined by the appended claims and reasonable equivalents thereof.

Figure 12A:
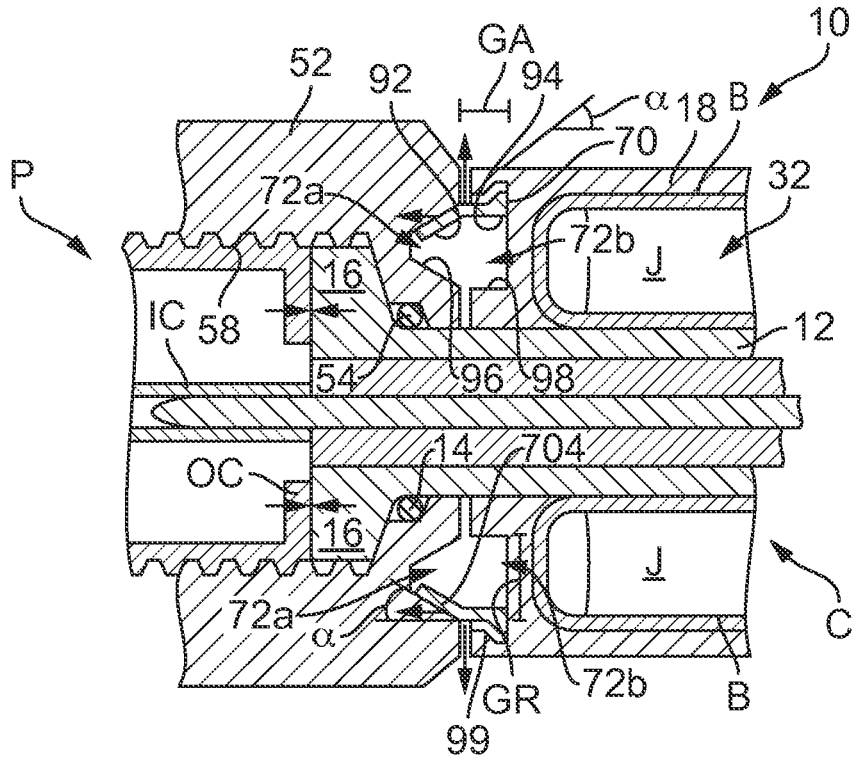
FIG. 12*a* is a longitudinal sectional view of another embodiment utilizing a radially biased hybrid band having an inclined surface to impose an axially biasing force to urge the flange of the coupling member into the flange of the post.

In other embodiments of the disclosure shown in FIGS. **12*a*-14, the recesses cooperate with the arcuate bridge member to produce an axial force on the coupling member which, in turn, urges the post against the port. As such, the post is "constantly biased" against the port to achieve enhanced grounding of the connector and coaxial cable. More specifically, in FIG. 12*a*, the recesses 72*a*, 72*b* of the coupling member 52 and outer sleeve 18 or body member define internal contact surfaces 92 and 94, respectively, which are axially spaced along the elongate axis 10A of the connector 10. The contact surface 92 defined by the recess 72*a* of the coupling member 52 diverges outwardly so as to form a cone or frustum shaped surface. The contact surface 94 defined by the sleeve 18 is normal to the elongate axis 10A and parallel to the base of the cone. In the described embodiment, the contact surfaces 92, 94 are separated along the elongate axis 10A by an axial distance GA. In a tightened state the contact surfaces 92, 94 are separated by an axial gap GA1 whereas in a loose state the contact surfaces 92, 94 are separated by an axial gap GA2. In the loose state, only a few threads of the coupling member 52** may be engaged with the threads of the interface port P.

In the described embodiment, each of the recesses 72*a*, 72*b* of the coupling member 52 and outer sleeve 18, also define outwardly directed contact surfaces 96 and 98, respectively, which are similarly spaced along the elongate axis 10A. Moreover, the inwardly and outwardly directed contact surfaces 92, 96 of the coupling member 52 and the inwardly and outwardly directed contact surfaces 94, 98 of the outer sleeve 18 each define a radial gap GR. Moreover, at the point where the sleeve and coupling member 18, 52 are separated, the inwardly and outwardly directed contact surfaces 92, 94, 96, 98 are essentially equidistant from the elongate axis 10A of the connector 10.

The conductive band or arcuate bridge member 70H is similar to the previously described flat band embodiment, however, the arcuate bridge member 70H defines an outwardly directed contact surface 95 (See FIG. 12*b*) which complements the shape of at least one of the internal contact surfaces 92, 94. That is, for example, at least a portion of the arcuate bridge member 70H includes a positively inclined surface complementing a negatively inclined surface of the internal contact surface 92 of the coupling member 52. The outward bias of the arcuate bridge member 70H, which is created by spring loading the ends 70E of the band 70H against the internal contact surfaces 92, 94, produces a constant bias of the coupling member 52 against the flange 16 of the post 12. This, in turn, urges the post 12 into electrical contact with the outer conductor OC of the port P. On the other hand, the positively inclined or sloping surface 95 of the arcuate bridge member 70H causes the opposite side or portion of the band 70H to abut, i.e., to be urged against the radially or vertically aligned contact surface 96 of the sleeve 18. As such, an electrical ground path is maintained across the axial gap GP between the coupling member 52 and the sleeve 18.

In the described embodiment, the positively inclined, internal, contact surface 92 of the arcuate bridge member 70H defines an angle $\alpha$ within a range of approximately thirty degrees (30°) to sixty degrees (60°). Similarly, the internal contact surface 92 of the coupling member 52 defines a negatively sloping surface within the same thirty to sixty degree range (30°-60°).

While the internal contact surface 94 of the outer sleeve 18 is shown to be parallel to the elongate axis 10A, or a straight angle, it should be appreciated that the internal contact surface 94 may form other complementary configurations. For example, the arcuate bridge member 70H may include an outwardly directed flange 97 for being received within an annular notch or groove in the internal contact surface 94 of the outer sleeve 18. The notch or groove 99 may function to retain the arcuate bridge member 70H within the outer sleeve of the connector 10, or to preposition the arcuate bridge member 70H during transport and assembly of the connector 10.

Figure 12B:
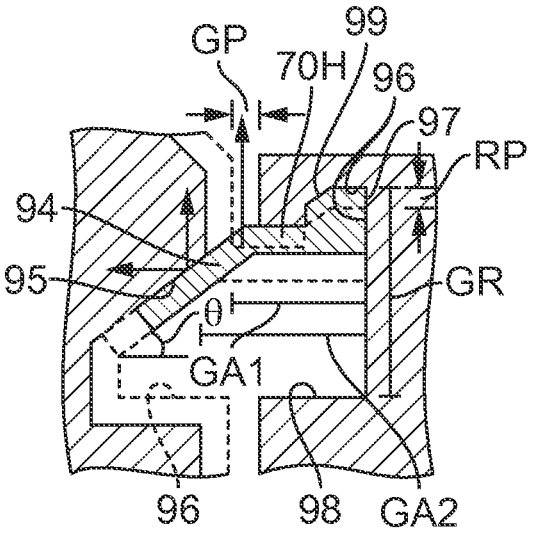
FIG. 12*b* is an enlarged view of a pair of face-to-face recesses formed in the sleeve and coupling member of the connector showing movement of the hybrid band from a tightened state (shown in dashed lines) to a loose state (shown in solid lines) wherein the coupling member is biased against the flange 16 of the post 12.

The arcuate bridge member 70H spans the gap GP (FIG. 12*b*) between the coupling member 52 and the outer sleeve 18. Additionally, the arcuate bridge member 70H spans the radial gap GR between one of the outwardly directed contact surfaces 96, 98 and one of the internal contact surfaces 92, 94 of the coupling member 52 and outer sleeve 18. As such, the band 70H facilities grounding when the axial and radial gaps GA, GR vary in dimension and placement. That is, the arcuate bridge member 70H enables the coupling member 52 and the sleeve 18 to separate and/or become radially misaligned, e.g., the outer sleeve 18 being shifted radially with respect to the coupling member 52. In FIG. 12*b*, the arcuate bridge member 70H is radially spaced from the contact surface 96 such that an initial radial gap RP is created. The gap RP is produced to allow the arcuate bridge member 70H to move radially, thereby allowing the complementary conical surfaces 94, 95 to slide axially relative to each other.

In the described embodiment, the arcuate bridge member 70H may be fabricated from a resilient conductive material such as a copper alloy having a mixture of copper, tin and steel to provide the proper spring stiffness. Alternatively, the arcuate bridge member 70H may be fabricated from a thermoplastic having a conductive coating bonded to the outwardly directed contact surface of the arcuate bridge member 70H.

Figure 13:
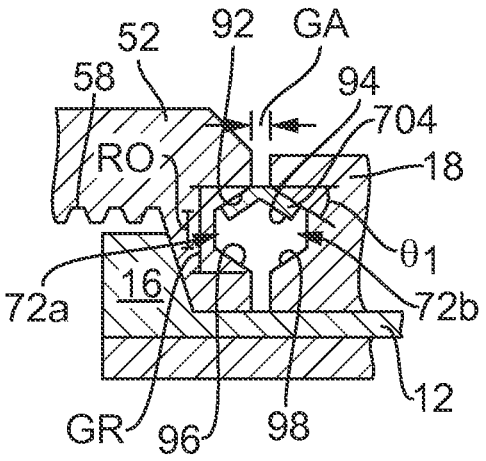
FIG. 13 is an enlarged view of the recess employing another embodiment of the hybrid arcuate bridge member.
Figure 14:
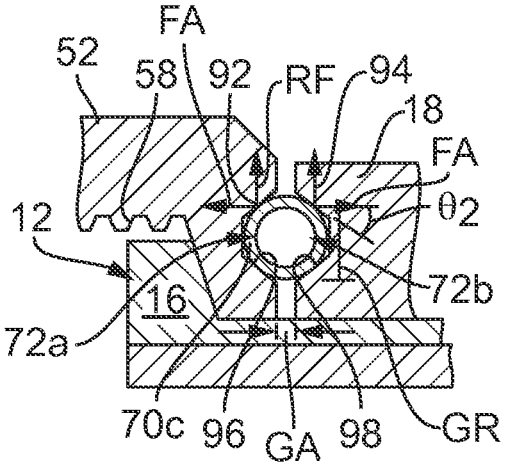
FIG. 14 is an enlarged view of another embodiment of the inventive connector including a recess having inclined surfaces to effect an axial biasing force on the flange of the coupling member to urge the flange of the post into contact with an interface port.

In FIGS. 13 and 14, each of the recesses 72*a*, 72*b*, may include conical or frustoconical surfaces on each of the inwardly and outwardly directed contact surfaces 92, 96 of the coupling member 52 and the inwardly and outwardly directed contact surfaces 94, 98 of the outer sleeve 18. As used herein "conical surface" means any frustoconical, sloping or inclined surface capable of producing an axial component of force when reacting a radial force. The conical surfaces 92, 94, 96, 98 may form a V-shaped or U-shaped recess having converging side surfaces 92, 94, 96, 98 separated by a radial distance RD (see FIG. 13). In FIG. 13, the internal contact surfaces 92, 94 each define an angle $\theta_1$ which complements the outwardly facing contact surface of the arcuate bridge member 70H. In FIG. 14, a coil spring 70C substitutes for the arcuate bridge member 70H, and relies on the deformation of each turn of the coil to (i) span the axial gap for grounding proposes, and (ii) produce a biasing force on the coupling member 52 to urge the post 12 against the port P. Whether a arcuate bridge member 70H or coil spring 70C are used to electrically span the axial gap GA, the sloping inwardly and outwardly facing contact surfaces 92, 94, 96, 98 produce axial components FA of the radial force RF which are additive to enhance the biasing force produced by the arcuate bridge member 70H or coil spring 70C.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. A coaxial cable connector, comprising:

a post comprising a first flange and defining an elongate axis;

a sleeve positioned around the post and comprising a second flange, the post and the sleeve configured to retain an end of a coaxial cable;

a coupling member comprising a third flange and positioned around the forward end of the post and configured to be disposed at least partially between the first flange and the second flange; the flanges of the sleeve and the coupling member forming recesses each defining an internal contact surface, the internal contact surfaces separated by an axial gap;

a grounding member, disposed in combination with one of the sleeve and the coupling member and biased outwardly against at least one of the internal contact surfaces, the grounding member configured to produce a force component in a radial direction to compensate for axial separation between the sleeve and the coupling member, the radial force causing the grounding member to bridge the axial gap between the internal contact surfaces and maintain electrical grounding between the sleeve and the coupling member even when the sleeve does not electrically contact the coupling member.

2. The coaxial cable connector of claim 1 wherein the grounding member is integral with one of the sleeve and the coupling member.

3. The coaxial cable connector of claim 1 wherein the grounding member is non-integral with one of the sleeve and the coupling member.

4. The coaxial cable connector of claim 1 at least one of the internal contact surfaces of the sleeve and the coupling member define an inclined surface.

5. The coaxial cable connector of claim 1 wherein at least one of the internal contact surfaces of the sleeve and the coupling member define an inclined surface.

6. The coaxial cable connector of claim 5 wherein the external contact surface of the grounding member defines a complementary inclined surface.

7. The coaxial cable connector of claim 1 wherein the grounding member is connected to one of the sleeve and the coupling member by an outwardly directed flange received within an annular groove of one of the sleeve and the coupling member.

8. The coaxial cable connector of claim 1 wherein the grounding member comprises a C-shaped arcuate bridge member.

9. The coaxial cable connector of claim 1 wherein the external contact surface of the grounding member defines a frustum-shaped surface.

10. The coaxial cable connector of claim 1 wherein the internal contact surfaces collectively define a V-shaped cross-sectional configuration.

11. The coaxial cable connector of claim 1 wherein the internal contact surfaces of the sleeve and the coupling member are radially equidistant from the elongate axis at the location of the axial gap.

12. A connector comprising:

a post comprising a first flange and defining an elongate axis;

a sleeve positioned around the post and comprising a second flange, the post and the sleeve configured to retain an end of a coaxial cable;

a coupling member comprising a third flange and positioned around the forward end of the post and configured to be disposed at least partially between the first flange and the second flange; the flanges of the sleeve and the coupling member forming recesses defining inwardly-facing internal contact surfaces separated by an axial gap, each annular recess having an outwardly-facing external contact surface which, in combination with the respective internal contact surface, defines a radial gap; and a grounding member disposed in combination with one of the sleeve and the coupling member, the grounding member comprising an outwardly-facing external contact surface configured to engage the inwardly-facing internal contact surface of one of the sleeve and the coupling member, the outwardly-facing external contact surface spanning the axial gap therebetween and biased radially outwardly against the inwardly-facing internal contact surfaces to maintain an electrical ground path therebetween even when the sleeve does not electrically contact the coupling member.

13. The connector of claim 12 wherein the grounding member is integral with one of the sleeve and the coupling member.

14. The connector of claim 12 wherein the grounding member is non-integral with one of the sleeve and the coupling member.

15. The connector of claim 12 wherein the recesses are disposed in substantially face-to-face relation.

16. The connector of claim 12 wherein the grounding member comprises an arcuate conductive bridge portion which spans an arc greater than about one-hundred and eighty degrees (180) around the elongate axis of the post.

17. The connector of claim 16 wherein the arcuate conductive bridge portion is substantially C-shaped.

18. The connector of claim 12 wherein the internal contact surfaces are radially equidistant from the elongate axis at the location of the axial gap.

19. The connector of claim 18 wherein the grounding member includes an arcuate band having one portion which contacts an internal contact surface of one of the sleeve and the coupling member and another portion which contacts an external contact surface of one of the sleeve and the coupling member so as to electrically span the radial gap.

20. The connector of claim 12 wherein the ends of the band contact the internal contact surfaces of the recesses and wherein an intermediate portion of the band contacts the outwardly facing contact surface of the band to electrically span the radial gap.

21. The connector of claim 12 further comprising an annular seal interposing the third flange of the coupling member and the first flange of the post.

22. A connector comprising:

a post defining an elongate axis;

a sleeve positioned around the post and configured to retain an end of a coaxial cable;

a coupling member positioned around the forward end of the post; the sleeve and the coupling member forming recesses defining internal contact surfaces separated by an axial gap; and a grounding member disposed in combination with one of the sleeve and the coupling member, the grounding member comprising an external contact surface configured to engage the internal contact surface of one of the sleeve and the coupling member, the external contact surface spanning the axial gap therebetween and biased radially outwardly against the internal contact surfaces to maintain electrical grounding therebetween even when the sleeve does not electrically contact the coupling member.

23. The connector of claim 22 wherein the grounding member is integral with one of the sleeve and the coupling member.

24. The connector of claim 22 wherein the grounding member is non-integral with one of the sleeve and the coupling member.

25. The connector of claim 22 wherein the recesses are disposed in substantially face-to-face relation.

26. The connector of claim 22 wherein the grounding member comprises an arcuate conductive bridge portion which spans an arc greater than about one-hundred and eighty degrees (180) around the elongate axis of the post.

27. The connector of claim 26 wherein the arcuate conductive bridge portion is substantially C-shaped.

28. The connector of claim 22 wherein the internal contact surfaces are radially equidistant from the elongate axis at the location of the axial gap.

29. A grounding member between a sleeve and a coupling member of a coaxial cable connector when the sleeve and the coupling member are not electrically connected, the grounding member comprising:

an arcuate conductive portion having a generally C-shaped configuration and an external contact surface; the arcuate conductive portion configured to: (i) be disposed within a recess formed in at least one of the sleeve and the coupling member, (ii) be radially biased outwardly such that the external contact surface is configured to engage an internal contact surface of at least one of the sleeve and the coupling member, and (iii) span an axial gap between the internal contact surfaces disposed between the recesses of the sleeve and the coupling member.

30. The grounding member of claim 29 wherein the external contact surface comprises a coil-shaped arcuate bridge.

31. The grounding member of claim 29 wherein the external contact surface comprises at least one frustum-shaped surface.

32. The grounding member of claim 29 wherein the external contact surface comprises a pair of opposed frustum-shaped surfaces which produce a substantially V-shaped cross-sectional configuration.

33. The grounding member of claim 29 further comprising a flange projected from an edge of one of the external contact surfaces, the flange configured to be received within an annular groove of one of the sleeve and the coupling member.

34. The grounding member of claim 29 wherein the arcuate conductive portion comprises an arcuate conductive band.

35. The grounding member of claim 29 wherein the arcuate conductive portion comprises a separate component from the sleeve and the coupling member.

* * * * *